United States Patent [19]

Rinaldi

[11] Patent Number: 4,841,688

[45] Date of Patent: Jun. 27, 1989

[54] MODULAR PAVILION

[75] Inventor: Rinaldo Rinaldi, Bogliasco, Italy

[73] Assignee: Riri Italia, S.p.A., Vignole Borbera, Italy

[21] Appl. No.: 82,002

[22] Filed: Aug. 5, 1987

[30] Foreign Application Priority Data

Aug. 5, 1986 [IT] Italy ..... 21411 A/86

[51] Int. Cl.[4] ..... E04H 15/18

[52] U.S. Cl. ..... 52/63; 52/86; 52/641

[58] Field of Search ..... 52/63, 67, 86, 639, 52/641, 90, 93; 47/17

[56] References Cited

U.S. PATENT DOCUMENTS

| | | | |
|---|---|---|---|
| 2,986,150 | 5/1961 | Torian | 47/17 |
| 3,165,110 | 1/1965 | Brooks | 47/17 |
| 3,255,769 | 6/1966 | Lloyd | 52/63 |
| 3,563,257 | 2/1971 | Cummins | 52/63 |
| 3,780,477 | 12/1973 | Sprung, Jr. | 52/63 |
| 3,855,643 | 12/1974 | Sanford et al. | 52/86 |
| 4,076,431 | 2/1978 | Burwall | 47/17 |
| 4,137,687 | 2/1979 | Sprung | 52/63 |
| 4,583,331 | 4/1986 | Hunt et al. | 52/63 |
| 4,644,706 | 2/1987 | Stafford et al. | 52/63 |

FOREIGN PATENT DOCUMENTS

| | | | |
|---|---|---|---|
| 2099880 | 12/1982 | United Kingdom | 52/63 |

OTHER PUBLICATIONS

Derwent Abstract of Canadian Pat. 1204267, dated May 1986.

Derwent Abstract of U.S. Pat. No. 4,063,566, issued Dec. 1977.

Derwent Abstract of German Pat. DE3537306, dated Apr. 1987.

Derwent Abstract of Australian Pat. 8661276, dated Jan. 1987.

Derwent Abstract of French Patent 2577591, dated Aug. 1986.

Derwent Abstract of U.S. Pat. No. 3,699,986, issued Oct. 1972.

Derwent Abstract of U.S. Pat. No. 3,912,138, issued Oct. 1975.

Derwent Abstract of U.S. Pat. No. 3,965,915, issued June 1976.

Derwent Abstract of U.S. Pat. No. 4,102,352, issued July 1978.

*Primary Examiner*—Michael Safavi

*Attorney, Agent, or Firm*—Nixon & Vanderhye

[57] ABSTRACT

A pavilion is comprised of a plurality of spaced, generally parallel frames, each having elongated modular elements connected one to the other by joints. Adjustable spacers are provided to connect the frames one to the other. Each modular element includes a pair of channels along opposite sides thereof for receiving enlarged margins of internal and external canvases, respectively, extending between the modular elements of adjacent frames. The spacers are adjusted to tension the canvases between the frames. Each modular element has a spigot as its central core to ensure rigidity. The modular elements are secured at their ends to joints which have channels forming continuations of the channels of the elements whereby the canvases may be drawn through the channels. The pavilion is thus extendable by the additional of further frames and canvases and readily and easily knocked down for transport.

5 Claims, 4 Drawing Sheets

MODULAR PAVILION

BACKGROUND AND SUMMARY OF THE INVENTION

The invention relates to a knock-down or disassemblable pavilion particularly designed as a temporary shelter for persons. Such pavilion includes at least a supporting framework with at least two, preferably canvas, coverings, one positioned externally and the other one internally. Such framework includes modular elements which can be connected to the edges of the above mentioned canvas so as to define a habitable cell which can be modularly connected to and supported by one or more additional cells so as to enable change in both the size and shape of the above mentioned pavilion.

As known, tents designed and used to shelter persons in conjunction with outdoor activities have been available on the market for a long time. The same is true for tents designed and used in conjunction with sheltering persons during natural disasters and also sheltering military personnel during simulated military exercises.

A significant feature of a tent for use in conjunction with the above mentioned events (and other similar ones) are those deriving from the advantage of assembling and disassembling the tent both very quickly and with extreme ease. Such tent should also offer the additional advantage of possessing an extremely rigid structure that can withstand any adverse weather condition.

Frequently, traditional tents (particularly the camp tents used by the military) are composed of a framework, generally made of metal tubes which can be connected together, whose installation requires the user to strictly follow certain mounting procedures. This is because the various elements which support the structure are generally made in different sizes according to the particular use for which they are destined.

In addition to the above, it is often difficult to carry out the installation of the canvas and its tensioning on the finished framework because both operations are dependent on the particular use of the tensioning rods, elastic items and restraining stakes to be driven into the ground upon which the tent is to be mounted. It is clear from the above that such a structure does not enable the preparation of a camp tent within a reasonable period of time or without considerable difficulties.

Another substantial inconvenience comes from the fact that the particular structure of those tents presently on the market does not enable assembly of a plurality of tents to form a pavilion of any given shape or size according to the uses or needs of the moment.

Last but not least is that traditional camp tents, composed of chemically treated canvas, offer only normal weatherproof features and a very low, if nonexistent, degree of thermal insulation. This disadvantage makes the camp tents unusable (or usable with great difficulty) in those areas where the climate is very cold or very hot.

It is a primary object of the present invention to eliminate the above mentioned inconveniences by creating a pavilion which can be readily and easily disassembled and used as a temporary shelter for persons.

Another object of this invention is to create a knock-down pavilion designed to be set up quickly and with extreme ease.

Still another object of this invention is to create a knock-down pavilion whose shape and size can be changed according to the needs of the particular moment and without having to use special mounting procedures or additional elements.

A further object of this invention is to create a knock-down pavilion which affords a high degree of thermal insulation enabling its use both in very cold and very hot climates.

A still further object of this invention is to create a knock-down pavilion which can be mounted even by unskilled persons or persons not trained for this specific task and also, a pavilion that would not be dependent on the morphology of the terrain on which is mounted in order to have those features of rigidity and resistance to nature's elements.

This particular task is achieved by a knock-down or disassemblable pavilion designed specifically as a temporary shelter for persons and characterized by the fact that it includes at least a supporting framework with at least an external and internal canvas, and modular elements connectable to the edges of a pair of canvases so as to define a habitable cell which is modularly connectable with at least another cell so as to change the size of the disassemblable pavilion.

In accordance with the present invention, there is provided a modular pavilion comprising a supporting framework including a plurality of frames each spaced one from the other and comprised of elongated modular elements interconnected one with the other, spacers releasably connecting the frames one to the other, interior and exterior flexible sheets extending between adjacent frames for substantially enclosing the pavilion and means carried by the modular elements for mounting the marginal edges of the interior and exterior sheets such that the interior and exterior sheets are spaced one from the other.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Figure 4:
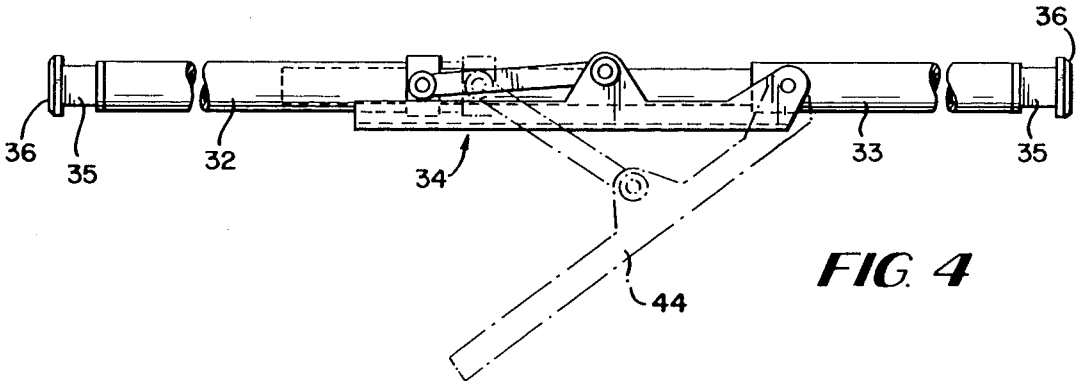
FIG. 4 is an elevational view with parts broken out of a particular type of spacer constructed in accordance with the invention.

With reference to the figures mentioned above, the knock-down or disassemblable pavilion, specifically designed as a temporary shelter for persons in accordance with the present invention, is generally indicated at 1. Pavilion 1 is comprised of an external canvas 2 made of a material chemically treated to significantly withstand nature's elements, and an internal canvas 3 significantly lighter than the external canvas 2 and suitable to create, inside a cell 4 which is part of pavilion 1, one or more partitions. Both canvas 2 and 3 are supported by a supporting framework, generally indicated at 5, which include several modular elements 6, which can be advantageously connected with the opposite edges of the external and internal canvases 2 and 3, respectively, so as to define cells 4. Each cell 4 is, in turn, modularly connectable to another adjacent cell so as to enable the user to change the size and configuration of pavilion 1 according to the necessities and requirements of that particular moment as well as the morphology of the terrain.

Appropriately, each elongated modular element 6 presents a symmetric form having opposite faces of similar configuration. Each face is provided with two channels 7 and 8 (FIG. 8) having a "C" shaped configuration all along each modular element 6 so that they are parallel to each other and also parallel to the axis of element 6.

Figure 3:
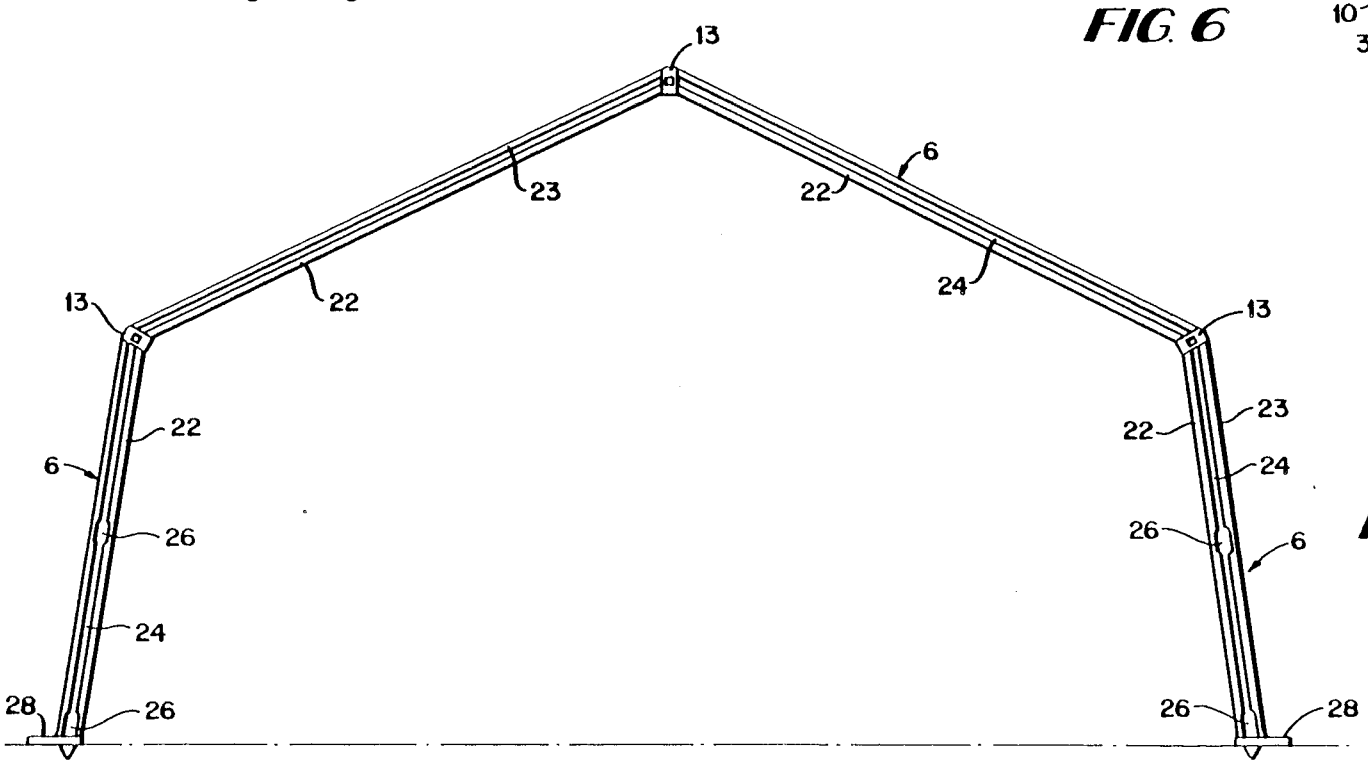
FIG. 3 is a schematic, elevational view of modular elements which comprise the supporting structure of the pavilion hereof.
Figure 7:
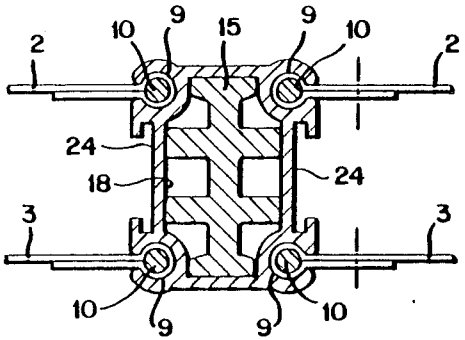
FIG. 7 illustrates, in cross section, the coupling of a spigot with a modular element in accordance with the present invention.
Figure 5:
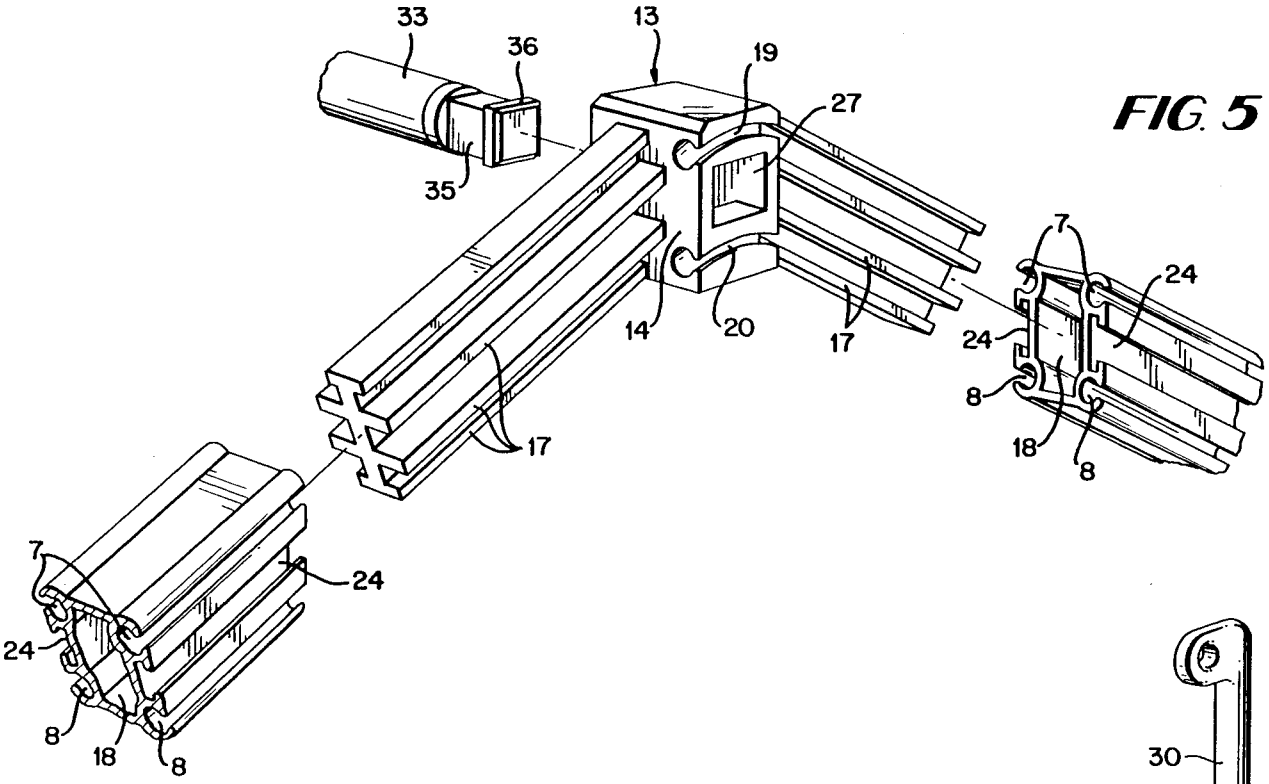
FIG. 5 is a fragmentary perspective view of a joint connecting the modular elements hereof in accordance with the invention.
Figure 9:
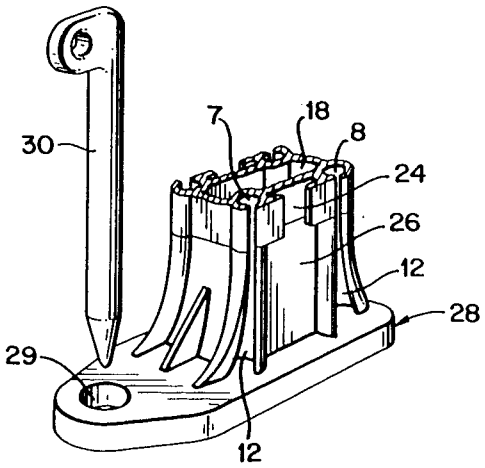
FIG. 9 is a partial perspective view of the supporting feet of the modular element in accordance with the invention.
Figure 10:
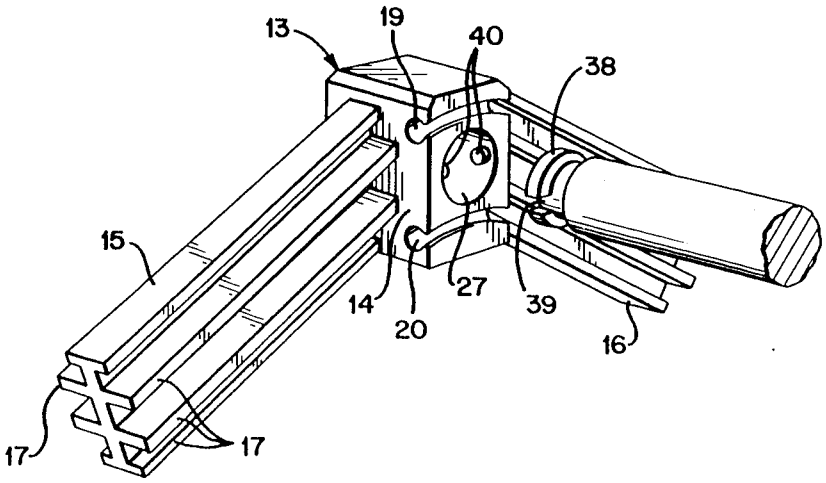
FIG. 10 illustrates a particular type of connection between a spacer and the joint of FIG. 5 in accordance with the invention.

The edges of both the internal and external canvases have enlarged margins 9 created by a cord 10 (FIG. 7) which is wrapped and sewn to the edge of the corresponding canvas so that such marginal edges can be inserted in channels 7 and 8 through enlarged openings 12 provided in channels 7, 8 of supporting feet 28 (FIG. 9) as described in more detail hereinbelow, thus enabling a connection between the canvases and modular elements. Thus, when the canvases are both connected to the modular elements 6 (for example, when they are interconnected to create a portal as shown in Figure 3), they are equally spaced from one another so as to create a hollow space therebetween suitable to greatly increase the thermal insulation of each cell 4 and, therefore, of the entire pavilion. Modular elements 6 are interconnected by means of modular joints 13 each comprising a central body 14 from where two spigots or internal support members 15 and 16 (FIG. 10), respectively, originate and extend in opposite directions but with variable inclinations according to the needs of the moment. Spigots 15 and 16 have several beads or projecting ribs 17 symmetrically positioned on opposite faces of the same spigots and suitable to self engage by friction in a cavity of the modular elements 6.

It is also important to point out that the central body 14 of each modular joint has on opposite faces, on opposite sides of the spigots, two channel-like slots 19 and 20 (FIG. 10), parallel to one another, with a substantially arched configuration and equally spaced to the distance of channels 7 and 8 so that, when two modular elements 6 are coupled by means of the interposition of joint 13, the channel-like slots 19 and 20 match perfectly and without discontinuity the channel-like slots 7 and 8 of the modular elements 6. This creates continuous sliding guides 22 and 23 for the margins 9 of the respective canvases.

Appropriately, the modular elements have, between channels 7 and 8, connecting areas 24 which are suitable to receive, as more precisely described hereinafter, spacers 25 (FIG. 2) for one or more portals created by the connection of several joints 13 and several modular elements 6. Particularly, modular elements 6 have inwardly directed flanges for securing the spacers to elements 6. Elements 6 are provided with break areas 26 between channels 7 and 8 in which there are no flanges for securing spacers 25 to enable easy insertion of spacers 25 in the connecting areas 24. Central body 14 is provided with a cavity 27 suitable to receive spacers 25.

To support and hold to the ground each cell 4, and therefore the entire pavilion 1, the supporting framework 5 is provided with supporting feet 28 (FIG. 9) having enlarged lower areas of introduction 12 and break areas 26 on the channels to facilitate the insertion into the modular elements of both the canvases and spacers. From feet 28, there is provided a coaxial or coextensive spigot, not visible in the drawings, but having a configuration similar to that of spigots 15 and 16 and engaging in cavity 18 of the modular elements extending from feet 28. The base of feet 28 is enlarged and provided with a hole 29 in which a stake 30 can be inserted so as to secure the feet to the ground.

Spacers 25 can be made in different ways. One spacer that satisfies most of and solves the technical problems connected with the tensioning of the canvas comprised of two bars 32 and 33 whose open ends respectively engage the modular elements and/or the modular joints. These bars 32 are provided with extending members generically indicated with the number 34.

Figure 6:
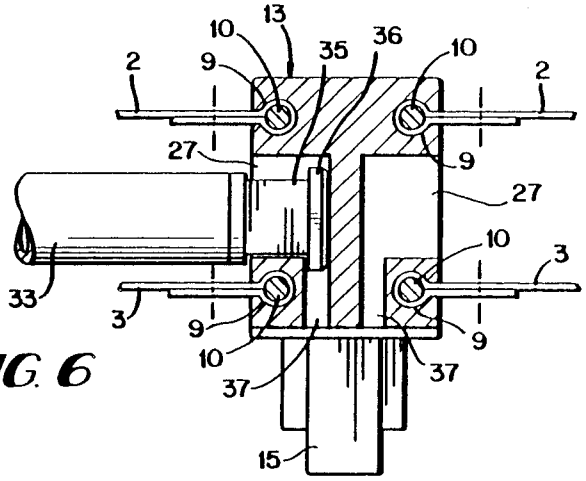
FIG. 6 is a cross-sectional view of the joint of FIG. 5.

The open ends of bars 32 and 33 have a small head 35 (FIG. 4), which can be inserted into the cavity 27 of the joint. Each head 35 has a flange 36 which can be engaged in a recess 37 (FIG. 6) of the same cavity 27 so as to restrain the bars in the respective joints.

Alternatively, the small heads 35 can be made by means of a bayonet joint. In this case, they will have a circular flange 38 (FIG. 10) interrupted by two diametrical slots 39 for receiving pins 40 disposed in cavity 27.

Figure 8:
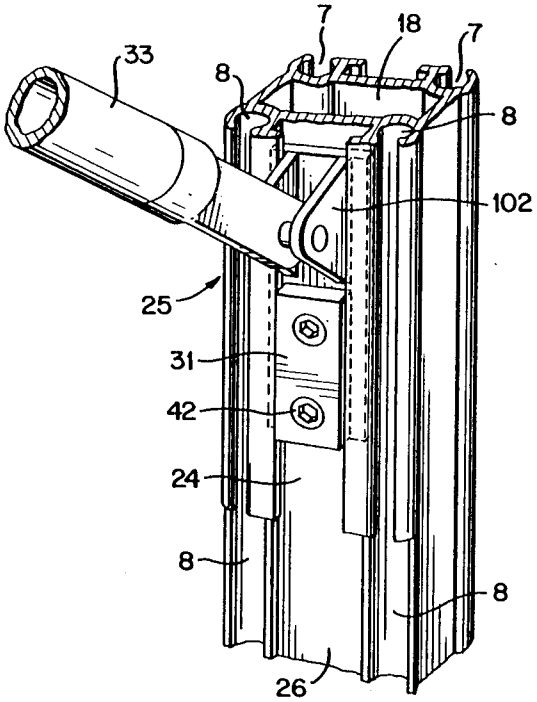
FIG. 8 is a fragmentary perspective view of the end of a spacer with a sliding shoe engaged in the connecting area of a modular element in accordance with the present invention.

In a different form hereof, bars 32 and 33 have ends hinged to sliding shoes each formed by clevis 102 and plate 31 (FIG. 8) which can be inserted in connecting areas 24 and secured therein by locking means, more precisely, by a plate with socket head or allen head screws plate Thus, as depicted in FIG. 8, the shoe has a base with laterally projecting flanges. When the shoe is butted against the modular element 6 in the break area 26, it may then slide lengthwise along element 6 such that its lateral flanges underlie the flanges of element 6. By threading the Allen head screws 42 against element 6, the shoes may be secured to element 6 in adjusted positions therealong.

Figure 2:
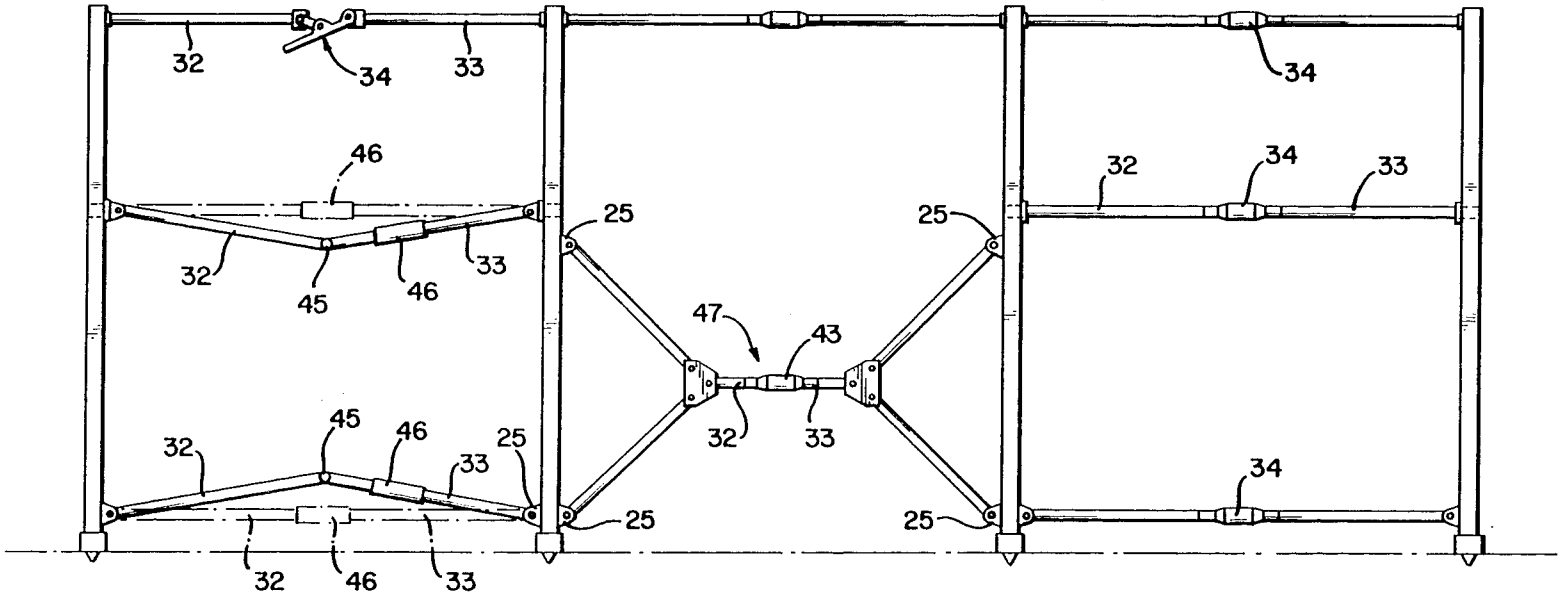
FIG. 2 is a schematic, elevational view illustrating different types of spacers for tensioning the external and internal canvases in accordance with the invention.
Figure 1:
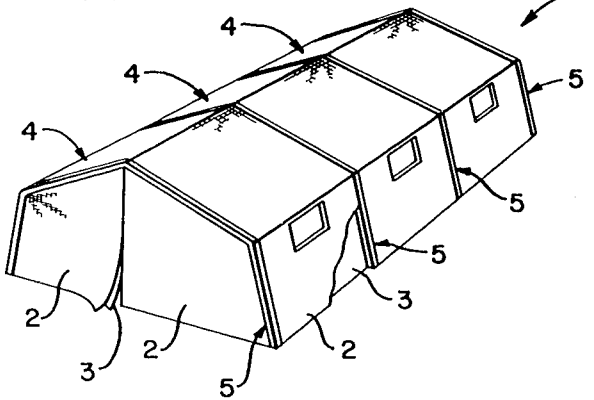
FIG. 1 is a perspective view of a particular configuration of a pavilion in accordance with the present invention.

The extending members 34 can be either a coupling 43 provided with counterclockwise threads to carry out, during its rotation, the distancing of the coaxial bars, or an extending device 44 or a connecting joint 45 of the two bars whose elongation is obtained by moving them from a first position in which they are slanting with respect to each other to a second, coaxial position maintained as such by means of a locking sleeve 46. As shown in FIG. 2, the spacers can also be made by means of a cross 47 which can also be extended by means of coupling 43 and is provided at the ends with sliding shoes 31 as in FIG. 8.

In the event only one cell 4 has to be made, this will be closed by front and rear external canvases and by respective front and rear internal canvases.

The assembly, according to the invention, of the disassemblable pavilion is characterized by the extreme ease and quickness of execution: the individual modular elements 6 are first assembled by using the modular joints. After having positioned two portal structures or frames to the proper equidistance, these structures are connected with the spacers. Then, the external canvas is inserted in the proper channels 7 of both portals by using a small pulling cable.

The exact tensioning of the external canvas is obtained by operating the spacers. Then, the internal canvas, lighter then the external one, is inserted in channels 8 so as to create that hollow space between the two canvas which gives the tent a high degree of thermal insulation.

After having completed the tensioning of the external canvas, the portal structures are secured to the ground by means of stakes inserted in the holes of the structures' feet. If one wishes to enlarge the pavilion to satisfy certain needs, the canvases of another cell or tent will be inserted in the same portal of the first cell and the previously described assembly procedure will be repeated.

It is clear that the pavilion, disassemblable in accordance with the invention, is particularly advantageous because it offers an extreme flexibility of use since it is composed of modular elements and since it can be enlarged and changed in configuration by connecting together additional cells or tents. This pavilion can therefore be used, for example, like a shelter for good, a temporary lodging for people or, by using a transparent sheet, a greenhouse for flowers and plants. The pavilion object of this invention offers the very substantial advantage achieving a very high degree of thermal insulation as a result of the hollow space between the two canvas.

Also, this pavilion can be assembled on any type of terrain because its sturdiness and firmness are not diminished by any morphology of the terrain on which it stands.

Assembly of the pavilion also does not require the use of any external rods or fastidious tensioning elastic tools.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A modular pavilion comprising:

a support framework including a plurality of frames each spaced one from the other and comprised of a plurality of elongated modular elements, and modular joint means for connecting adjacent ends of said modular elements;

spacers releasably connecting said frames one to the other;

interior and exterior flexible sheets having marginal edges and extending between adjacent frames for substantially enclosing the pavilion; and means integrally formed in said modular elements and said modular joint means for slidably receiving the marginal edges of said interior and exterior sheets such that the interior and exterior sheets are spaced one from the other, each of said frames including a plurality of said modular joint means, interconnecting adjacent ends of said modular elements, said elements and said modular joint means lying in a common plane, wherein said sheets are spaced one from the other in spaced generally parallel planes, with said sheets extending between adjacent frames, each of said elements having a pair of channels extending parallel to one another and substantially coextensive in length therewith for receiving said marginal edges of the interior and exterior sheets, the sheets being formed of canvas, the margins of which have enlarged portions for reception in said channels, a shoe, said modular elements including means for receiving said shoe for lengthwise sliding movement thereof along said element and retaining said shoe on said element during said sliding movement thereof, means for releasably connecting said shoe and said modular element one to the other, means on said modular element at a predetermined location therealong enabling removal of said shoe from said element, and means for pivotally connecting said shoe and one end of said spacer one to the other.

2. A pavilion according to claim 1 including means for adjusting the length of said spacers between adjacent frames thereby to adjust the tension of the canvas therebetween.

3. A pavilion according to claim 1 wherein said frame includes a spigot disposed with each said modular element for reinforcing the latter.

4. A modular pavilion comprising:

a support framework including a plurality of frames each spaced one from the other and comprised of a plurality of elongated modular elements, and modular joint means for connecting adjacent ends of said modular elements;

spacers releasably connecting said frames one to the other;

interior and exterior flexible sheets having marginal edges and extending between adjacent frames for substantially enclosing the pavilion; and means integrally formed in said modular elements and said modular joint means for slidably receiving the marginal edges of said interior and exterior sheets such that the interior and exterior sheets are spaced one from the other, each of said frames including a plurality of said modular joint means, interconnecting adjacent ends of said modular elements, said elements and said modular joint means lying in a common plane, wherein said sheets are spaced one from the other in spaced generally parallel planes, with said sheets extending between adjacent frames, each of said modular joint means being comprised of a body with cavities opening to opposite sides thereof, at least one of said spacers comprising an elongated support element having opposite ends adapted for insertion in the cavities of said modular joint means of next adjacent frames to interconnect adjacent frames one to the other, and whereby said elongated support element extends substantially perpendicularly to said common plane, said body having two generally parallel channel-like slots spaced one from the other and on said opposite sides thereof, a pair of said modular elements terminating at said joint body and having a pair of channels extending parallel to one another and substantially coextensive in length with the elements, said channel-like slots in said body and said channels in said modular element forming continuations with one another without substantial discontinuity for forming continuous sliding guides for the marginal edges of said interior and exterior sheets.

5. A modular pavilion comprising:

a support framework including a plurality of frames each spaced one from the other and comprised of a plurality of elongated modular elements, and modular joint means for connecting adjacent ends of said modular elements;

spacers releasably connecting said frames one to the other;

interior and exterior flexible sheets having marginal edges and extending between adjacent frames for substantially enclosing the pavilion; and means integrally formed in said modular elements and said modular joint means for slidably receiving the marginal edges of said interior and exterior sheets such that the interior and exterior sheets are spaced one from the other, each of said modular joint means being comprised of a body with cavities opening on opposite sides thereof, at least one of said spacers comprising an elongated support element having opposite ends adapted for insertion in the cavities of the modular joint means of next adjacent frames to interconnect adjacent frames one to the other, said body also having generally parallel channel-like slots spaced one from the other and on said opposite sides thereof, a pair of said modular elements terminating at said joint body and having a pair of channels extending parallel to one another and substantially coextensive in length with the elements, said channel-like slots in said body and said channels in said elements forming continuations with one another without substantial discontinuity for forming continuous sliding guides for the marginal edges of said interior and exterior canvases.

* * * * *